US008629608B2

(12) United States Patent
Deme et al.

(10) Patent No.: US 8,629,608 B2
(45) Date of Patent: Jan. 14, 2014

(54) FLUORESCENT LAMP OF IMPROVED LUMEN MAINTENANCE AND MERCURY CONSUMPTION

(75) Inventors: István Károly Deme, Budapest (HU); Miklós Budai, Budapest (HU); Zoltán Hórvölgyi, Budapest (HU); Márta Kabai Jánosné, Budapest (HU)

(73) Assignee: General Electric Company, Schenectady, NY (US)

( * ) Notice: Subject to any disclaimer, the term of this patent is extended or adjusted under 35 U.S.C. 154(b) by 62 days.

(21) Appl. No.: 13/309,668

(22) Filed: Dec. 2, 2011

(65) Prior Publication Data

US 2013/0140980 A1 Jun. 6, 2013

(51) Int. Cl.
*H01J 1/62* (2006.01)
*H01J 63/04* (2006.01)

(52) U.S. Cl.
USPC ..... 313/489; 313/483; 313/567; 313/634; 313/635

(58) Field of Classification Search
USPC ..... 313/483–486, 489, 567, 578, 634, 635, 313/637–643
See application file for complete search history.

(56) References Cited

U.S. PATENT DOCUMENTS

| | | | | |
|---|---|---|---|---|
| 3,886,396 | A | 5/1975 | Hammer et al. | |
| 4,607,191 | A * | 8/1986 | Flaherty | 313/489 |
| 4,670,688 | A | 6/1987 | Sigai et al. | |
| 4,952,422 | A | 8/1990 | Pappalardo et al. | |
| 4,999,219 | A | 3/1991 | Klinedinst | |
| 5,126,166 | A | 6/1992 | Dutta et al. | |
| 5,309,069 | A | 5/1994 | Sigai | |
| 5,604,396 | A | 2/1997 | Watanabe | |
| 5,958,591 | A | 9/1999 | Budd | |
| 2003/0218415 | A1 | 11/2003 | Matsuo | |
| 2005/0073239 | A1 * | 4/2005 | Srivastava et al. | 313/487 |
| 2006/0113885 | A1 * | 6/2006 | Iimura | 313/485 |
| 2006/0284561 | A1 * | 12/2006 | Nishimura et al. | 313/635 |
| 2007/0200503 | A1 | 8/2007 | Olson | |
| 2007/0228924 | A1 | 10/2007 | Justel | |
| 2009/0027875 | A1 * | 1/2009 | Terada et al. | 362/97.2 |
| 2009/0121612 | A1 * | 5/2009 | Uchiyama | 313/489 |
| 2009/0128742 | A1 * | 5/2009 | Hashimoto et al. | 349/70 |
| 2009/0160341 | A1 | 6/2009 | Justel | |
| 2009/0160342 | A1 * | 6/2009 | Iida | 313/643 |

OTHER PUBLICATIONS

Search Report and Written Opinion for Corresponding PCT Application No. PCT/US2012/063638, dated Feb. 14, 2013.

* cited by examiner

*Primary Examiner* — Anh T. Mai
*Assistant Examiner* — Kevin Quaterman
(74) *Attorney, Agent, or Firm* — Peter T. DiMauro; Global Patent Operation

(57) ABSTRACT

The inner surfaces of fluorescent lamp tubing are provided with a phosphor coating. The phosphor coating defines an inward-facing surface. A protective coating is deposited on the inward-facing surface of the phosphor coating. The protective coating defines an innermost surface and makes effective recombination of Hg ions possible on the innermost surface of the second coating before the Hg ions collide with the phosphor particles in the phosphor coating.

10 Claims, 4 Drawing Sheets

FLUORESCENT LAMP OF IMPROVED LUMEN MAINTENANCE AND MERCURY CONSUMPTION

FIELD OF THE INVENTION

The field of the present invention generally involves lighting, and more particularly relates to fluorescent lamps and methods of making same.

BACKGROUND OF THE INVENTION

A fluorescent lamp operates by passing an electric discharge through mercury vapor contained within an envelope to produce short-wave ultraviolet (UV) light (generally at wavelengths of about 253.7 nm and 185 nm). The envelope bears a phosphor material which is caused to luminesce by the UV light, thereby emitting visible light. As a practical matter, many commercial fluorescent lamps may suffer from a decrease of lumen as a function of burning time. One reason for lumen decrease is the bombardment of the phosphor material by mercury ions and by 185 nm ultraviolet light from the discharge. The amount of mercury bound by the phosphor coating also increases with burning time, which may lead to a consumption of up to around half of the total amount of mercury consumed inside the lamp. This loss of mercury can also lead to lumen decrease. These effects may seriously limit the service life of the lamps.

BRIEF DESCRIPTION OF THE INVENTION

One embodiment of the present invention includes a fluorescent lamp having a protective coating on the inwardly-facing surface of the phosphor coating of the fluorescent lamp, thus partly protecting the phosphor coating from the harmful effects of the discharge.

In another embodiment of the present invention, a fluorescent lamp is made by a process that includes the step of applying a protective coating onto the inwardly-facing surface of the phosphor coating of the fluorescent lamp.

The present invention also may include the step of making the phosphor coating resistant to washing ("wash-proofing") before applying the protective coating.

The present invention also may include size-enhancing the particles of the suspension that are applied to the inwardly-facing surface of the phosphor coating to form the protective coating before applying the protective coating.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
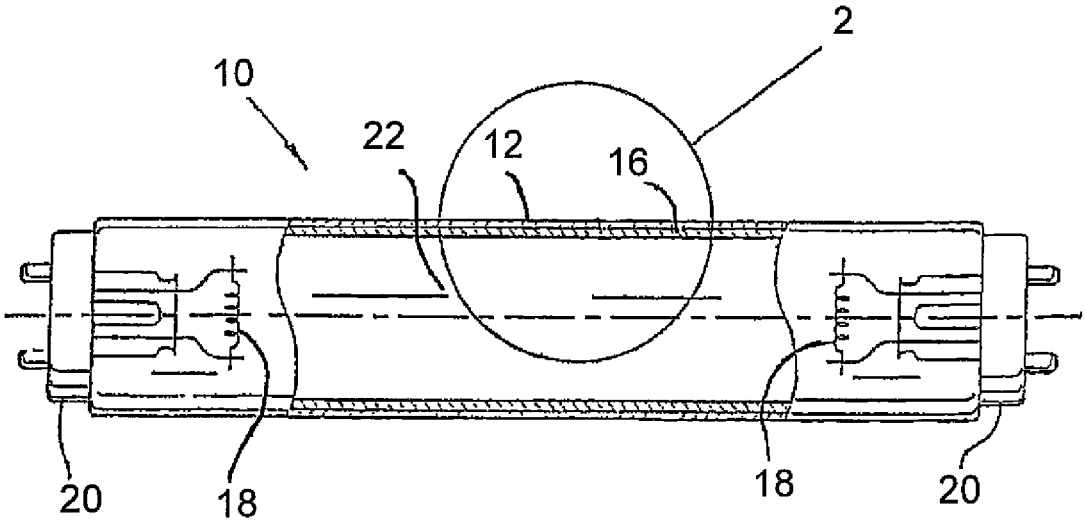
FIG. 1 shows an embodiment of a mercury vapor discharge fluorescent lamp according to the present invention with portions cut away and portions shown in cross section.

Referring to FIG. 1, a mercury vapor discharge fluorescent lamp 10 according to an embodiment of the present invention is schematically depicted with portions cut away and portions shown in cross section. Though the lamp in FIG. 1 is linear in the shape of a right cylinder, the invention is not limited to linear lamps and may be applied to fluorescent lamps of any shape. The exemplary fluorescent lamp 10 has a light-transmissive glass tube or envelope 12, which has a cross-section that is circular when taken normal to the longitudinal axis of the lamp 10.

As used herein, a "fluorescent lamp" is any mercury vapor discharge fluorescent lamp as known in the art, including fluorescent lamps wherein the discharge source includes electrodes, and also electrode-less fluorescent lamps wherein the discharge source includes a radio transmitter adapted to excite mercury vapor atoms via transmission of an electromagnetic signal.

Also as used herein, a "T8 lamp" is a fluorescent lamp as known in the art, desirably linear in the shape of a right cylinder, desirably nominally 48 inches in length, and having a nominal outer diameter of 1 inch (eight times ⅛ inch, which is where the "8" in "T8" derives). However, the T8 fluorescent lamp can be nominally 2, 3, 6 or 8 feet long, or some other length. Moreover, the method and apparatus disclosed herein is applicable to other lamp sizes and loadings, ranging from T12 to T1 in diameter, and including compact fluorescent lamp (CFL) types as well.

As schematically shown in FIG. 1, the lamp 10 is hermetically sealed at each of the opposite ends of the glass envelope 12 by a base 20 attached at one of the two spaced apart opposite ends of the glass envelope 12 and another base 20 attached at the other one of the two spaced apart opposite ends of the glass envelope 12. Embodiments of lamps such as that in FIG. 1 include a discharge source, which may comprise at least one electrode structure 18 desirably respectively mounted on each of the bases 20 and is disposed in the interior volume of the envelope 12. A compact fluorescent lamp for example might require only a single electrode 18. Each of the electrodes 18 typically is formed of tungsten coils that have been coated with emission material that has a low thermionic emission temperature and thus emits electrons at relatively low temperatures. Electricity passing through each of the coils generates enough heat to attain the thermionic emission temperature of the emission material, which continuously decreases during burning.

Figure 2:
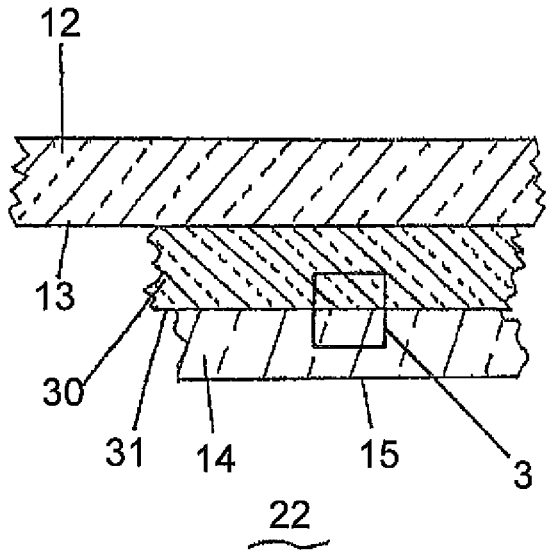
FIG. 2 schematically shows in an enlarged cross sectional view, the detail circumscribed by the circular balloon designated by the numeral 2 in FIG. 1.

As schematically shown in FIGS. 1 and 2, a discharge-sustaining fill gas 22, comprising mercury and an inert gas, is sealed within the interior volume of the glass tube 12. The inert gas desirably is argon or a mixture of argon and krypton, but could be some other inert gas or mixture of inert gases. The inert gas and a small quantity of mercury vapor provide the low vapor pressure manner of operation. During operation, the mercury vapor desirably may have a pressure in the range of about 0.8 Pa to about 1.2 Pa.

Figure 5:
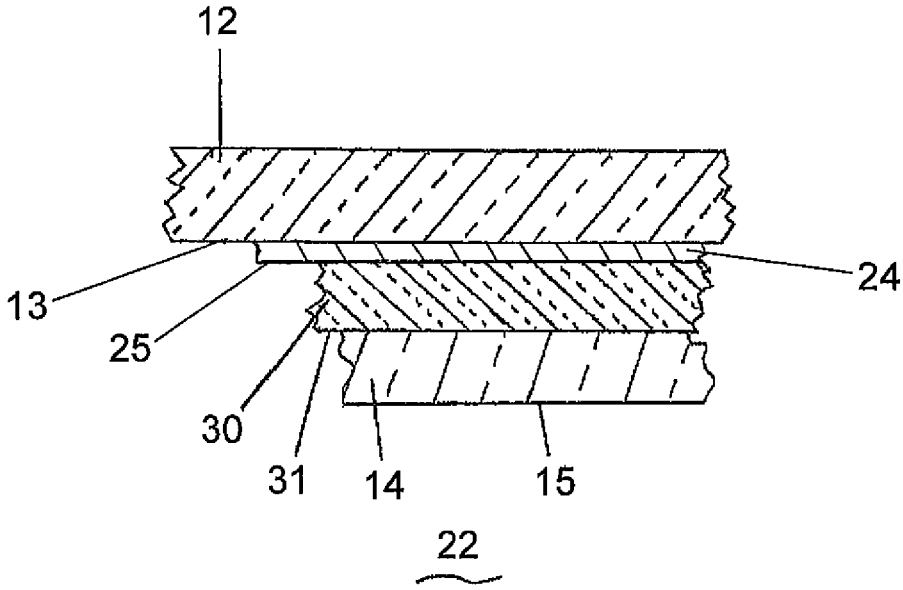
FIG. 5 schematically shows in an enlarged cross sectional view, an alternative embodiment of the detail circumscribed by the circular balloon designated by the numeral 2 in FIG. 1.

As schematically depicted in FIG. 2, which shows an enlarged cross sectional view of the portion of the drawing in FIG. 1 identified by the balloon designated 2, the glass envelope 12 has an inner surface 13 that is cylindrical and defines an interior volume of the glass envelope 12. As schematically shown in FIGS. 1 and 2, the fluorescent lamp 10 has a phosphor coating layer 30 that contains one or more phosphors. As schematically shown in FIG. 2, this phosphor coating layer 30 can be applied directly onto the inner surface 13 of the envelope 12 of a fluorescent lamp 10 to convert UV light to visible light. Alternatively, as schematically shown in FIG. 5, this phosphor coating layer 30 can be applied directly onto the inner surface 25 of a barrier coating 24 that itself has been applied directly onto the inner surface 13 of the envelope 12 of a fluorescent lamp. As generally known, a "phosphor" is a luminescent material that absorbs radiation energy in a portion of the electromagnetic spectrum and emits energy in another portion of the electromagnetic spectrum. One important class of phosphors comprises crystalline inorganic compounds of high chemical purity and of controlled composition to which small quantities of other elements (called "activators") have been added to convert them into efficient fluorescent materials.

this disclosure, a convention is employed in which "inner" means "closer to the mercury discharge" and "outer" mean "further from the mercury discharge". Therefore, for example, an "inner surface" or "innermost surface" of a phosphor coating 30 is that surface of a layer which is closer to the mercury discharge in the lamp.

As schematically shown in FIG. 2 for example, in one embodiment the phosphor coating layer 30 may be formed on a substantial portion of the inner surface 13 of the envelope 12. The phosphor coating layer 30 can include one or more compositions of material that include one or more phosphors.

Figure 3:
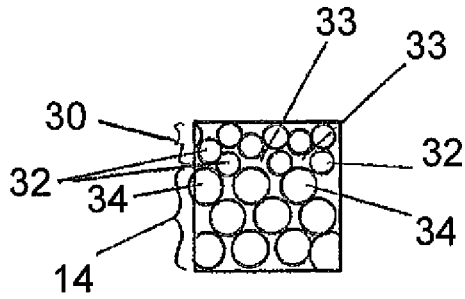
FIG. 3 schematically depicts an enlarged view of square box designated by the numeral 3 in FIG. 2.

As schematically shown in FIG. 3, one exemplary embodiment of the phosphor coating layer 30 includes phosphor particles 32. These phosphor particles 32 may comprise any phosphor material, such as one or more of the many known phosphor materials, such as rare earth phosphors and/or halophosphors. An exemplary but nonlimiting listing of phosphors suitable for use in the phosphor composition may include one or more of the following: zinc silicate [$Zn_2SiO_4$:Mn]; strontium green-blue [$Sr_5(PO_4)_3(F,Cl):Sb^{3+}$, $Mn^{2+}$]; strontium red [$Sr_3$ $(PO_4)_2:Sn^{2+}$]; SECA [$Sr_{5-x-y}Ba_x Ca_y(PO_4)_3Cl:Eu^{2+}$]; CBT [$GdMgB_5O_{10}:Ce^{3+}$, $Tb^{3+}$]; CBM [$GdMgB_5O_{10}:Ce^{3+}$, $Mn^{3+}$]; BAM [$BaMg_2Al_{16}O_{27}:Eu^{2+}$]; BAMn [$BaMg_2Al_{16}O_{27}:Eu^{2+};Mn^{2+}$]; magnesium fluoro germanate [$3.5(MgO)*0.5(MgF_2)*GeO_2:Mn^{4+}$]; SAE [$Sr_4Al_{14}O_{25}:Eu^{2+}$]; SEB [$SrB_4O_7:Eu^{2+}$] and yttrium vanadate [$Y(P,V)O_4:Eu^{3+}$].

The phosphor coating layer 30 may also comprise other materials, such as fine particle inorganic additive materials, such as alumina, silica, yttria, etc., which may function to increase adhesion of the phosphor particles to the glass surface 13 and to each other. Other possible components may comprise one or more of thickeners, dispersants or surfactants, as would be well understood in the industry to regulate physical properties of a suspension used to apply the phosphor coating layer 30. As explained more fully below, water-soluble dispersants and water soluble polymeric thickeners such as polyethylene oxide may be desirable.

The phosphor coating layer 30 can be applied to the inner surface 13 of glass envelope 12 (or to a barrier coating 24) by any effective means, including many known coating means. As schematically shown in FIG. 5, in many fluorescent lamps a barrier coating 24 is applied directly onto the inner surface 13 of the glass envelope 12 in order to shield the glass envelope 12 from the mercury discharge and/or to reflect part of any UV light that may leak through the phosphor coating layer 30. A barrier coating 24 may be composed of one or more of fine particle alumina, yttria, silica, titania, water insoluble borates or phosphates, etc. If the phosphor coating layer 30 is applied to either the glass envelope 12 (FIG. 2) or the barrier coating 24 (FIG. 5) as a slurry, the phosphor coating 30 may be dried via any effective means, such as by forced air convection. After being dried, the phosphor coating layer 30 may baked ("lehred") at an elevated temperature, e.g. at least 400° C. to 650° C. for about 0.5-10 minutes to burn out any organic components of the slurry.

As schematically depicted in FIG. 3 for example, the resulting the phosphor coating layer 30 defines an inwardly-facing surface 31 (FIG. 2). Importantly, such surface 31 of the phosphor coating layer 30 may typically include voids 33 between adjacent phosphor particles 32. These voids 33 may have dimensions that can range up to as large as several (e.g., ten) micrometers. Now, in the exemplary embodiment schematically depicted in FIG. 2, in addition to a phosphor coating layer 30, a protective coating 14 is applied over the inwardly-facing surface 31 of the phosphor coating layer 30, in this embodiment schematically depicted in FIG. 2, the protective coating 14 is applied directly on the inwardly-facing surface 31 of the phosphor coating layer 30. Thus, the phosphor coating layer 30 desirably is disposed between the inner surface 13 of the envelope 12 (or between the barrier layer 24) and the protective coating 14.

The protective coating 14 generally is substantially transparent to UV light of 254 nm wavelength. It may also be substantially transparent to the whole of the visible light spectrum. Moreover, as schematically depicted in FIG. 2, the protective coating 14 defines an innermost surface 15. The protective coating 14 typically is configured to inhibit collision of Hg ions with phosphor particles in the phosphor coating; that is, it has a function of mitigating the collision of Hg ions with phosphor particles in the phosphor coating 30. One manner in which the protective coating 14 may fulfill this function, is by effecting the recombination of Hg ions at the innermost surface 15 of the protective coating before the Hg ions collide with the phosphor particles 32 (FIG. 3) in the phosphor coating 30.

The protective coating 14 may comprise one or more of crystalline inorganic materials, or particulate amorphous materials; or the like. The protective coating 14 desirably can comprise one or more of the oxides, borates or phosphates of one or more of aluminum, yttrium, lanthanum, zirconium or magnesium, and combinations of two or more of the foregoing. The protective coating 14 may comprises particles 34 that possess a size such that particles 34 substantially do not enter the voids 33 between adjacent phosphor particles 32. That is, particles 34 of the protective coating 14 have an agglomerated particle size (e.g., size of secondary or tertiary agglomerates or flocs) that is larger than the void size of the voids 33 between adjacent phosphor particles 32. One manner in which to ensure that particles 34 possess a size such that particles 34 substantially do not enter the voids 33, is by size-enhancing the particles 34 through flocculation and/or agglomeration, as will be explained in further detail below. To promote transparency in the protective coating 14, as well as to promote collision with Hg ions, the particles in the protective coating may desirably have a small (e.g., nano-sized) primary particle size. However, it generally is advantageous to collect such small primary particles that compose the protective coating into aggregates (e.g., flocs) having a size sufficiently large so as to not enter or fall into voids in the phosphor coating layer.

Figure 4:
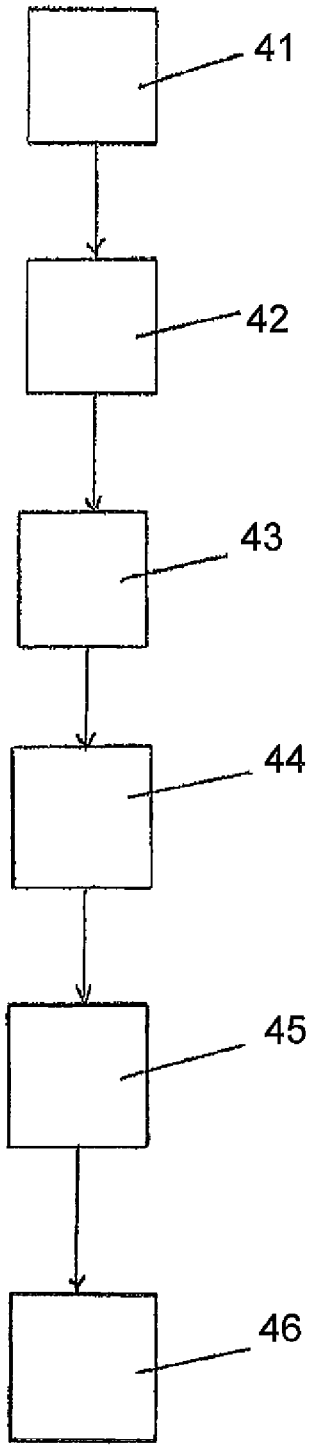
FIG. 4 schematically represents embodiments of the methods of the present invention for making a mercury vapor discharge fluorescent light source.

In accordance with embodiments of the present invention, methods are provided for making a light source 10 that includes a substantially transparent, hollow envelope 12 that has an inner surface 13 coated with a layer 30 including a phosphor composition. As schematically represented in FIG. 4, such methods desirably include a step 41 of applying a phosphor coating 30 on the inner surface 13 of the envelope 12. The phosphor coating 30 employed in step 41 may include a suspension of phosphor particles 32 in a water soluble binder mixed with other additives as known in the art. Once this suspension is applied to the inner surface 13 of the envelope 12, the phosphor coating 30 may be dried and baked as described above to provide an inwardly-facing surface 31 schematically shown in FIG. 2. As schematically represented in FIG. 3, the phosphor coating 30 contains voids 33 that may have dimensions in the range of from below about 1 micrometer to as large as several (e.g., 10) micrometers. Therefore, these voids 33 are present in the inwardly-facing surface 31 (FIG. 2) of the phosphor coating 30.

Generally, methods in accordance with embodiments of the invention may comprise a step of applying a suspension of material that is to form the protective coating 14 onto the inwardly-facing surface 31 of a dried phosphor coating 30. However, prior to performing this step, it may be necessary to ensure that the phosphor coating 30 does not become washed off during the step of applying a suspension. If any dried phosphor coating 30 becomes washed off during a subsequent step of applying a suspension, this may lead to unacceptable technical and aesthetic quality in the finished fluorescent tamp 10. Therefore, preventing the washing away of the dried phosphor coating 30 can be achieved by a step of "wash-proofing" (i.e., making the phosphor coating 30 wash resistant) the phosphor coating 30 before applying any subsequent suspension.

The step of wash-proofing the phosphor coating 30 can be achieved by baking the phosphor coating 30 and thus removing any dissolvable organic materials from it prior to applying the protective coating 14. Alternatively, the step of wash-proofing the phosphor coating 30 can be achieved by using a water-resistant binder within the phosphor coating, such as a water soluble polymer that can be made water resistant by drying with forced hot air circulation. This latter method may have advantages in cost and simplicity. A suitable choice for a water soluble polymer as the binder of the phosphor coating 30 can be the ammonium salt of acrylic (methacrylic) acid/acrylic (methacrylic) ester copolymer, preferably of high molecular mass. If a coating containing such a water-resistant binder is dried (e.g., at a temperature of at least 80 degrees C.) it becomes sufficiently water resistant to survive a subsequent water based coating step without being washed off. Thus the phosphor coating 30 can be made partly water insoluble by drying a wet phosphor coating 30 with hot air at 80 degrees C. or above. As schematically shown in FIG. 4, the step 41 of providing a phosphor coating 30 on the inner surface 13 of the envelope 12 desirably may also include the step of wash-proofing the phosphor coating 30.

As schematically represented in FIG. 4, methods for making a light source 10 may include a step 42 of providing a protective coating 14 on the inwardly-facing surface 31 of the phosphor coating 30. As schematically shown in FIGS. 2 and 3, the protective coating 14 defines an innermost surface 15 that may make possible the effective recombination of Hg ions on the innermost surface 15 of the protective coating 14, to inhibit the collision of Hg ions with the phosphor particles 32 in the phosphor coating 30. The radial thickness range of the protective coating 14 may be a value between about 0.01 micrometers and about 5 micrometers. Other thicknesses are possible.

In certain embodiments, the protective coating 14 should be transparent to visible light and as transparent to 254 nm UV light as possible. Certain materials can help the coating 14 fulfill both requirements. For example, the protective coating 14 may comprise aluminum oxide particles having a primary crystalline size of below about 20 nm with secondary (aggregate) particle diameters of about 0.05 micrometers to about 1 micrometer. Of course, the particles in the protective coating 14 may also comprise a flocculated or tertiary aggregated particle size which is larger than the voids between phosphor particles.

The step of providing a protective coating 14 on the inwardly-facing surface 31 of the phosphor coating 30 desirably can include a sat-gel process, in one embodiment, one may form the protective coating 14 from an aluminum oxide sol or aluminum hydroxy-oxide sol, such as boehmite sol. Such sol may be prepared under the following conditions to bring the precursor material into a form of colloidal dispersion (precursor sol): aluminum isopropoxide [$Al(OC_3H_7)_3$] (or other alkoxide) was added to an amount of distilled water (molar ratio of Al to $H_2O$=1:50) at 85° C. under vigorous stirring, which was maintained for half an hour. Nitric acid ($HNO_3$) then was added to peptize the hydroxide precipitate (molar ratio of Al and $HNO_3$=1:0.13). The stirring was then maintained for half an hour at 85° C. to obtain a clear boehmite sol, which is termed herein the "basic sol". After these steps, other materials (such as neutral polymers, e.g., polyvinyl pyrrolidone and/or polyethylene glycol, etc.) in a concentration of 0.05 g/100 mL to 0.5 g/100 ml solutions can be added to the basic sol to modify the properties of the basic sol and the resultant coatings. The conventional up-flush or down-flush processes then are applied to this precursor sol to obtain the liquid that is to be applied to the inwardly-facing surface 31 of the phosphor coating 30. The liquid that is applied to form the protective coating 14 contains a substantial amount of liquid (mainly water) that must be dried and treated at high temperature to develop a ceramic protective coating 14 having a radial thickness range that desirably is between about 0.01 micrometers and about 5 micrometers. These two steps may occur in the conventional drying and the subsequent lehring steps of the conventional manufacture of fluorescent lamps 10.

We return now to the matter of the dimension of the voids in the inwardly-facing surface 31 of the phosphor coating 30, and the particle size of the particles 34 in the protective coating 14. As noted above, the individual particles in the dispersed phase of the protective coating 14 may have a primary crystalline size of below about 20 nanometers (0.02 micrometers) and secondary (aggregate) particle diameters of about 0.05 micrometers to about 1 micrometer. However, as shown in the schematically enlarged view of FIG. 3, the phosphor coating 30 generally contains voids 33 that have dimensions in the range of below 1 micrometer and can range up to several micrometers. These voids 33 are present in the inwardly-facing surface 31 (FIG. 2) of the phosphor coating 30.

As schematically depicted in the enlarged view of FIG. 3, the phosphor particles 32 located at the inwardly-facing surface 31 (FIG. 2) of the phosphor coating 30 are the ones that are the closest to the discharge and thus are most exposed to the bombardment of mercury ions during the normal discharge that occurs during operation of the fluorescent lamp 10. The purpose of the protective coating 14 is to mitigate this. However, unless precautions are taken during the step of drying the protective coating 14, the particles of the protective coating 14 can fail into the voids 33. If this occurs, the protective coating 14 will fail to create a continuous protective layer over the top of the phosphor particles 32 located at the inwardly-facing surface 31 of the phosphor coating 30.

If the particles of the dispersion that is to form the protective coating 14 are to avoid falling into the voids 33 of the phosphor coating 30, some further aggregation may be desirable, e.g., aggregation to achieve a mildly flocculated tertiary structure. As schematically shown in FIG. 3, this undesirable condition can be prevented by size-enhancing the individual particles of the suspension used to form the protective coating 14. These size-enhanced particles then may then become large enough to span across the voids 33 of the inwardly-facing surface 31 of the phosphor coating 30 and thus avoid falling into these voids 33. One may effect such size-enhancement by the controlled flocculation (decrease of the colloidal stability) of the particles that form the suspension that is applied to form the protective coating 14. In the case of alumina particles (e.g. Aeroxide Alu C™ by Evonik), this mildly flocculated tertiary structure desirably can be achieved by using a suitable polyethylene oxide binder of high molecular mass that is capable of flocculating the aluminum oxide to the required extent (e.g. Polyox WSR N-3000™ by Dow Chemicals). Such controlled flocculation may cause colloids in the suspension to aggregate together into a size-enhanced particle 34 that exceeds the size of the voids 33 defined in the inwardly-facing surface 31 of the phosphor coating 30. Therefore, (and by reference to FIG. 3), controlled flocculation is one way to ensure that the size of the particles 34 of the protective coating 14 are larger than the size of the voids 33 defined between the phosphor particles 32 in the inwardly-facing surface 31 of the phosphor coating 30.

As schematically shown in FIG. 4, the step 42 of providing a protective coating 14 on the inwardly-facing surface 31 of the phosphor coating 30 may include controlled flocculation that size-enhances the flocculated particles 34 that form the suspension that is applied to form the protective coating 14. Thus, the application of the suspension with the size-enhanced particles 34 that is applied to form the protective coating 14 may create a continuous protective layer over the top of the phosphor particles 32 located at the inwardly-facing surface 31 of the phosphor coating 30.

There are alternative sequences of steps for providing a protective coating 14 on the inwardly-facing surface of the phosphor coating 30. For example, a chemical vapor deposition process can be used. For example, an airborne aerosol or vapor of a suitable precursor material (such as an aluminum alkoxide or trimethyl aluminum if an aluminum oxide coating is to form the protective coating 14) may be blown through a heated envelope 12 containing the phosphor coating 30. On the hot wall of the envelope 12, the precursor material undergoes a chemical reaction resulting in the required oxide coating on the phosphor coating 30. This chemical vapor deposition of the protective coating 14 can suitably be combined with the conventional lehring step of fluorescent lamp manufacture.

In an alternative formulation of the protective coating 14, the protective coating 14 may itself comprise some phosphor particles. However, in this embodiment, phosphor particles within the protective coating 14 are provided in a much smaller percentage than are present in the phosphor coating 30. In this embodiment, these phosphor particles may bring about the controlled flocculation that produces the size-enhancement in the mildly flocculated tertiary structure. In one exemplary embodiment, both the phosphor coating 30 and the protective coating 14 may comprise phosphors as well as alumina. In this embodiment, the alumina:phosphor ratio in the phosphor coating 30 is usually in the 0.5% to 4% range, and the protective coating 14 used 6% to 20% alumina relative to the weight of phosphor. Accordingly, the total phosphor content of the protective coating 14 was only a fraction of the total phosphor content of the underlying phosphor coating 30 (e.g., 5 weight % to 20 weight %). After lehring/baking (pyrolysing away the organics), one obtains a phosphor coating 30 composed of the same components as the protective coating 14 but having a sharp gradient in alumina distribution, the concentration of alumina being much higher in the thin protective coating layer 14.

Thereafter, as schematically represented in FIG. 4, the methods desirably call for the step 43 of installing a plasma discharge source in the envelope 12, which source is capable of creating a discharge from a fill comprising mercury and inert gas. As schematically represented in FIG. 4, the methods desirably may comprise a step 44 of evacuating the envelope 12. As schematically represented in FIG. 4, once the envelope 12 is evacuated, the methods may comprise step 45 of adding into the evacuated envelope 12, a gas 22 that includes a mercury and an inert gas. As schematically represented in FIG. 4, the methods may include a step 46 of sealing the envelope 12 to produce the light source 10.

Reference has been made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

It is to be understood that the ranges and limits mentioned herein include all sub-ranges located within the prescribed limits, inclusive of the limits themselves unless otherwise stated. For instance, a range from 100 to 200 also includes all possible sub-ranges, examples of which are from 100 to 150, 170 to 190, 153 to 162, 145.3 to 149.6, and 187 to 200. Further, a limit of up to 7 also includes a limit of up to 5, up to 3, and up to 4.5, as well as all sub-ranges within the limit, such as from about 0 to 5, which includes 0 and includes 5 and from 5.2 to 7, which includes 5.2 and includes 7.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A mercury vapor discharge lamp, comprising:

a sealed, substantially light-transmissive envelope having an inner surface;

at least one discharge source;

a fill comprising mercury and an inert gas sealed inside the envelope;

a phosphor coating disposed upon at least a portion of the inner surface of the envelope, the phosphor coating defining an inwardly-facing surface, the phosphor coating comprising a phosphor composition that includes phosphor particles, wherein the inwardly-facing surface of the phosphor coating defines voids that have a maximum dimension; and a protective coating on the inwardly-facing surface of the phosphor coating, the protective coating being substantially transparent to UV light of 254 nm wavelength, the protective coating being configured to inhibit collision of Hg ions with phosphor particles in the phosphor coating, wherein the protective coating comprises inorganic particles, and wherein a diameter of the inorganic particles of the protective coating exceeds the maximum dimension of the voids in the inwardly-facing surface of the phosphor coating.

2. The fluorescent lamp of claim 1, wherein the protective coating is configured to promote recombination of Hg ions.

3. The fluorescent lamp of claim 1, wherein the protective coating includes crystalline inorganic materials.

4. The fluorescent lamp of claim 1, wherein the protective coating includes particulate amorphous materials.

5. The fluorescent lamp of claim 1, wherein protective coating includes clumps, agglomerates, or flocs of inorganic particles that are larger than voids between adjacent phosphor particles.

6. The fluorescent lamp of claim 1, wherein the protective coating forms a continuous protective coating on the phosphor coating.

7. The fluorescent lamp of claim 1, wherein the protective coating includes one or more of the oxides, borates or phosphates of one or more of aluminum, yttrium, lanthanum, zirconium or magnesium, and combinations of two or more of the foregoing.

8. The fluorescent lamp of claim 1, the phosphor coating has been prepared by a step comprising making the phosphor coating into a wash-resistant form.

9. The fluorescent lamp of claim 1, wherein the discharge source comprises electrodes.

10. A mercury vapor discharge lamp, comprising:

a sealed, substantially light-transmissive envelope having an inner surface;

at least one discharge source;

a fill comprising mercury and an inert gas sealed inside the envelope;

a phosphor coating disposed upon at least a portion of the inner surface of the envelope, the phosphor coating defining an inwardly-facing surface, the phosphor coating comprising a phosphor composition that includes phosphor particles; and a protective coating on the inwardly-facing surface of the phosphor coating, the protective coating being substantially transparent to UV light of 254 nm wavelength, the protective coating being configured to inhibit collision of Hg ions with phosphor particles in the phosphor coating, wherein the protective coating includes one or more of the oxides, borates or phosphates of one or more of aluminum, lanthanum, zirconium or magnesium, and combinations of two or more of the foregoing.

* * * * *